United States Patent [19]

Woods

[11] 4,348,710

[45] Sep. 7, 1982

[54] METHOD AND STRUCTURE FOR COMPENSATING FOR VARIATIONS IN VAPOR COOLED LEAD RESISTANCE OF SUPERCONDUCTING MAGNETS

[75] Inventor: Eugene L. Woods, San Diego, Calif.

[73] Assignee: General Dynamics Corporation, San Diego, Calif.

[21] Appl. No.: 275,923

[22] Filed: Jun. 22, 1981

[51] Int. Cl.[3] ..... H01H 47/00

[52] U.S. Cl. ..... 361/141; 307/245; 307/306; 323/360; 335/216

[58] Field of Search ..... 361/141, 19; 323/360; 363/14; 335/216; 307/245, 306

[56] References Cited

U.S. PATENT DOCUMENTS 3,129,359 4/1964 Kunzler ..... 361/141
3,187,229 6/1965 Kunzler ..... 361/141
3,187,236 6/1965 Leslie ..... 174/15 CA X
3,278,808 10/1966 Bonfeld ..... 361/141
3,502,946 3/1970 Kimura ..... 361/141

*Primary Examiner*—Reinhard J. Eisenzopf
*Attorney, Agent, or Firm*—John R. Duncan; Frank D. Gilliam

[57] ABSTRACT

A superconducting magnet arrangement having a sealed cryogenic environment utilizing liquid helium, a superconducting coil immersed in the liquid helium, a constant current power supply exterior of the cryogenic environment and connected to the coil by leads cooled by varying helium boil off and an electrical shunt connect across the magnet. Variations in the helium boil off are compensated by exposing the shunt to and cooling it by the same helium boil off or by exposing negative temperature coefficient device to such flow or by a combination of such methods.

13 Claims, 4 Drawing Figures

METHOD AND STRUCTURE FOR COMPENSATING FOR VARIATIONS IN VAPOR COOLED LEAD RESISTANCE OF SUPERCONDUCTING MAGNETS

BACKGROUND OF THE INVENTION

1. Field of the Invention

This invention relates to improvements in superconducting magnets, and more particularly, but not by way of limitation to a novel method and structure for compensating for variations in vapor cooled lead resistance of superconducting magnets due to vapor flow.

2. Description of the Prior Art

Superconductivity is the property of certain materials, at temperatures approaching absolute zero, to carry current without power dissipation. Such materials, at temperatures below a certain critical temperature, Te, have no electrical resistivity, and therefore no $I^2R$ losses. Coils of such material in liquid helium baths, with currents induced by withdrawing a permanent magnet from a position within the helium, have carried the resulting currents for periods of two years without any voltage drop. The factors controlling superconductivity of such material are the interrelation of magnetic field strength, critical current density, and critical temperature Te. The magnetic field strength, applied externally or generated by a current in the superconductor, limits superconductivity to below certain temperatures and current densities.

The large current-carrying capacity of superconductors provides the basis for very compact, super powerful magnets which can be used in numerous applications where strong magnetic fields are required, for example, in MHD generators, lasers, masers, projectile launchers, accelerators, and bubble chambers. The capital and operating costs of a particular installation using such a magnet in place of a conventional electromagnet would be substantially less due to the smaller physical size and the absence of power consumption or heat dissipation requirements for the magnet itself.

It was found that when a superconducting coil was operated in an open Dewar there was a significant loss of liquid helium to the atmosphere. The liquid helium was then sealed within a vacuum tight Dewar with electrical leads from the magnet power supply, at approximately 70° F., penetrating the vacuum seal to make electrical contact or interface with the magnet coil, at around −425° F. The loss of liquid helium was, thus, reduced markedly.

It then became common to place a shunt across the superconducting magnet to compensate for magnet geometry variations among other things. Examples of such shunts and the reasons for which they have been employed are seen in U.S. Pat. Nos. 3,129,359; 3,187,229; 3,187,236; and 3,278,808.

It has also become common for large superconducting magnets or coils to employ vapor cooled electrical leads for the connection of a magnet power supply to a superconducting magnet. Because of frictional power losses and flux jump power losses within the magnet or coil some helium boil off still occurred within the sealed Dewar. The vapor cooled lead concept took advantage of the boil off or gaseous helium flow by using it to cool the power leads, thereby giving rise to the term "vapor cooled leads". Such vapor cooled leads are described for example in "vapor cooled leads", a performance specification (GDC specification number 11-36805, June 19, 1979).

During normal operation of a superconducting magnet, the magnet or coil will dissipate power due to the noted frictional and flux jump power losses. Characteristically, these losses are not constant thus the helium boil off is not constant and the associated cooling of the vapor cooled leads varies. This variation in coolant flow rate then causes the electrical resistance of the vapor cooled leads to vary due to the temperature coefficient for the particular material. Under normal operating conditions, the change of resistance in the vapor cooled leads would cause the current in the superconducting coil to change, if it were not for regulation of current level by the magnet or coil power supply. The power supply automatically compensates for variations in resistance of the vapor cooled leads and maintains the superconducting magnet or coil at the desired constant current level.

Current shunts have been used for many years to provide an economical method of varying the current (ampere-turns) in the magnet or coil. However, the use of a shunt on a large superconducting coil is not practical if the associated power supply must precisely regulate the amount of current in the superconducting coil or magnet. No matter how well constructed they may be, vapor cooled leads still exhibit electrical power, and thus, dissipate power as heat when a current is passed through them.

If a shunt, as seen in the aforementioned prior art, is now placed across the room temperature terminals of the vapor cooled leads, it effectively isolates the vapor cooled lead flow rate resistance change from the power supply. No corrective action is taken by the power supply since the shunt current would increase. With the customary shunt there would be a net decrease in magnet current and the shunt current would increase thereby masking the magnet current drop from the power supply so that it would be unable to correct for the drop in magnet current regardless of how well it was regulated. Thus, what appeared to be an economical way to vary magnet ampere-turns has been the cause of magnet current drift and resultant magnet field variations that might well be disastrous to a physical process dependent on a constant magnetic field.

SUMMARY OF THE INVENTION

Briefly stated, the novel invention pertains to a superconducting magnet arrangement having a sealed cryogenic environment utilizing liquid helium and a superconducting coil immersed in the liquid helium. A constant current power supply positioned exteriorly of the cryogenic environment is connected to magnet or coil by vapor cooled leads and a shunt is also connected across the magnet on the exterior of the cryogenic environment. The shunt is constructed to be cooled by the same vapor flow that cools the electrical leads of the coil. A negative temperature coefficient resistance means connected in series with the vapor cooled leads may be cooled by the vapor flow instead of the shunt to compensate for vapor cooled lead resistance variations and a compound arrangement of a vapor cooled shunt and a vapor cooled negative temperature coefficient resistance means in series with the vapor cooled leads may also be advantageously employed.

The above and other specific features of the instant invention will be readily apparent as the description continues while being read in conjunction with the appended drawings.

DETAILED DESCRIPTION OF THE PREFERRED EMBODIMENT

Throughout the drawings and specifications, the same numerals are used in the various figures to indicate the identical element or part.

Figure 1:
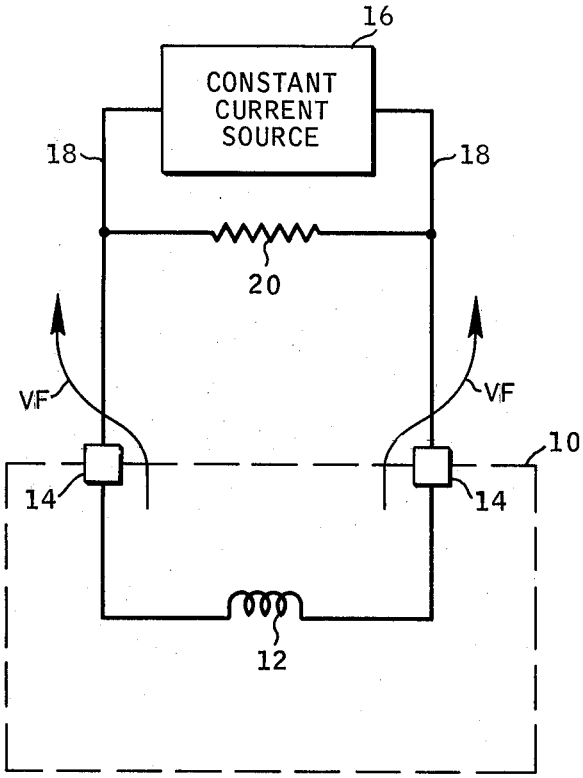
PRIOR ART FIG. 1
FIG. 1 is a diagrammatic representation of a typical superconducting magnet of the prior art having an uncompensated shunt.

Referring now to the figures, and in particular to FIG. 1, a diagrammatic illustration of a superconducting magnet or coil arrangement typical of the prior art is seen. This superconducting magnet or coil arrangement includes a suitable sealed cryogenic environment or cryostat 10 that is provided with a pool of liquid helium, not shown for ease of illustration. A superconducting coil 12 is immersed within the liquid helium of the vacuum tight cryostat 10 and is connected to the exterior of the cryostat 10 by suitable power leads 14. The power leads 14 are constructed to be cooled by the vapor boil off of the liquid helium as it is vaporized by frictional power losses and flux jump power losses within the magnet or coil 12 and are considered to be vapor cooled power leads. The flow of vapor through the leads 14 is shown generally by the lines VF.

The vapor cooled leads 14 are electrically connected to the coil 12 and are coupled to a suitable constant electrical current source 16 by suitable leads 18. Thus, the vapor cooled leads 14 provide an electrical connection from the magnet coil, at approximately −425° F., through leads 18 to a constant current power supply, at approximately 70° F. or room temperature. A shunt 20 is connected across the superconducting coil 12 exteriorly of the cryogenic environment 10, for example, to compensate for magnet geometry variations. While current shunts on magnets are well known for the purpose of providing an economical method of varying the amount of electrical current (ampere-terms) in the coil, the use of such a shunt on a large superconducting coil is not practical if the associated power supply must precisely regulate the amount of current in the magnet or coil.

No matter how well the vapor cooled power leads 14 may be constructed, they still exhibit electrical resistance and, thus, dissipate power. During normal operation of the superconducting magnet arrangement FIG. 1 the superconducting magnet 12 will dissipate electrical power due to frictional and flux jump power losses. Typically, these losses are not uniform with time and since the power dissipated by the coil 12 due to these reasons is not constant, the helium boil off tends to vary thereby causing the cooling of the vapor cooled power leads 14 by such vapor to vary. This variation in cooling and temperature of the power leads, due to the temperature coefficient of resistance, causes the resistance of the leads 14 to vary.

Normally, the resistance change in the power leads 14 would cause the current in the magnet or coil 12 to change and this change would be immediately corrected by the regulation of the electrical current level by the regulated constant current power supply 16. The power supply 16 will automatically compensate for variations in the resistance of the power leads 14 caused by vapor flow variation and maintain the magnet or coil current at a desired constant level and thereby maintain the magnetic field at the desired level.

However, with the connection of the shunt 20 across the coil 12 the variation in vapor cooled lead resistance is isolated or masked from the power supply 16 so that it does not compensate for the variation. The power supply 16 takes no corrective action to compensate for the decrease in magnet current since there has been an increase in the current through the shunt 20. It will be recognized that if the power supply 16 is isolated from the resistance change and concomitant current change in the power leads by the shunt current there can now be magnet current drift and magnetic field variations that could be disastrous to a physical process dependent on a constant magnetic field of coil 12.

Figure 2:
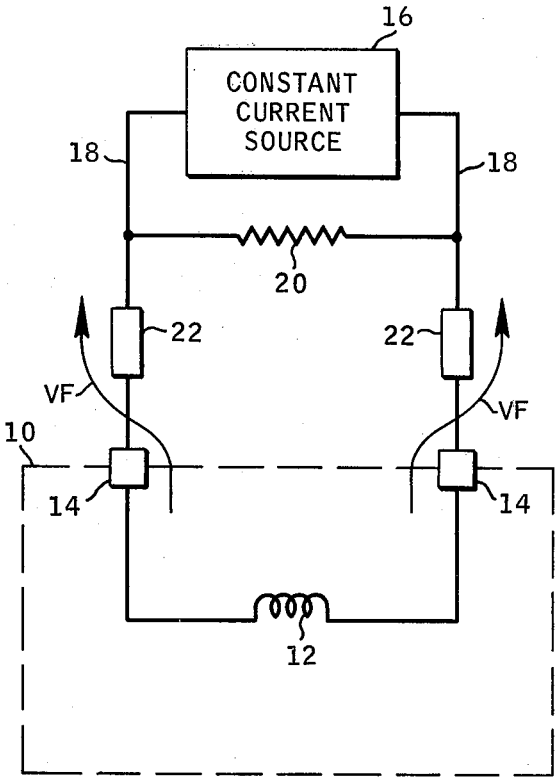
FIG. 2 is a diagrammatic representation of a first embodiment of a superconducting magnet arrangement embodying the present invention wherein a vapor cooled negative temperature coefficient material compensates the shunt.

Referring now to FIG. 2, a first embodiment of the novel invention is illustrated. A superconducting magnet arrangement is shown as before except that now an electrical means has been coupled to the constant current power supply 16 and to the superconducting coil 12 and arranged to be cooled by the same vapor flow VF applied to the power leads whereby the constant current power supply 16 is permitted to maintain a constant current through the superconducting coil 12 and to maintain a constant resultant magnetic field as variations in the electrical resistance of the leads occur due to vapor boil off of the liquid helium within the cryostat 10. In the first illustrated embodiment, this electrical means take the form of a negative coefficient of temperature resistance material 22 interposed in each lead 18 connecting each power lead 14 to the constant power supply 16 and being adapted to be cooled by the same vapor from the boiled off helium that is applied to the vapor cooled leads 14 as shown by vapor line VF. In this instance, as the resistance of the vapor cooled power leads 14 decreases due to vapor flow variation the resistance of the compensating device increases accordingly and the power supply 16 is able to precisely control the current flowing through the superconducting magnet or coil 12. Thus, a standard commercially available shunt 20 may be used.

Figure 3:
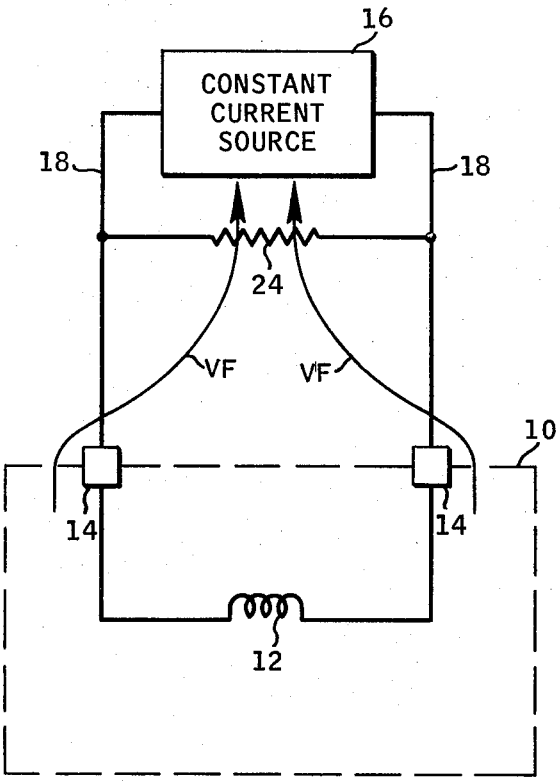
FIG. 3 is a diagrammatic representation of a second embodiment of a superconducting magnet arrangement embodying the instant invention wherein a vapor cooled positive temperature coefficient material compensates the shunt.

In a second embodiment of the invention shown in FIG. 3, the superconducting magnet arrangement illustrated includes a compensating shunt 24 that is constructed so that it is exposed to and cooled by the same vapor flow VF that cools the vapor cooled power leads 14. While the shunt 24 may be cooled by the vapor flow VF from one power lead 14 it is preferable to cool the shunt 24 with the vapor flow VF from both power leads 14. In the illustrated instance, for example, the cooling of the vapor cooled leads 14 has decreased since the flow rate from helium boil off has decreased. With a decrease in cooling, due to positive temperature coefficient of resistance the electrical resistance of the leads 14 increases and the magnet current through coil 12 will tend to decrease. However, with the provision of the compensated shunt 24, constructed for example of stainless steel which has a positive temperature coefficient, and the shunt 24 being connected to the same helium boil off flow as the leads 14 the shunt 24 then acts as a feedback mechanism. As with the vapor cooled leads 14, when the helium boil off rate falls and the electrical resistance of the shunt 24 goes up there is less current flow through the shunt 24. Thus, the change in current flow through the magnet 12 is not masked and the constant current source 16 may immediately react to maintain a constant level of electrical current through the coil 12. Since the cooling of the shunt 24 has been accomplished by the same vapor cooling the leads 14 such cooling has been achieved without increasing the amount of helium boil off of the cryostat 10.

Figure 4:
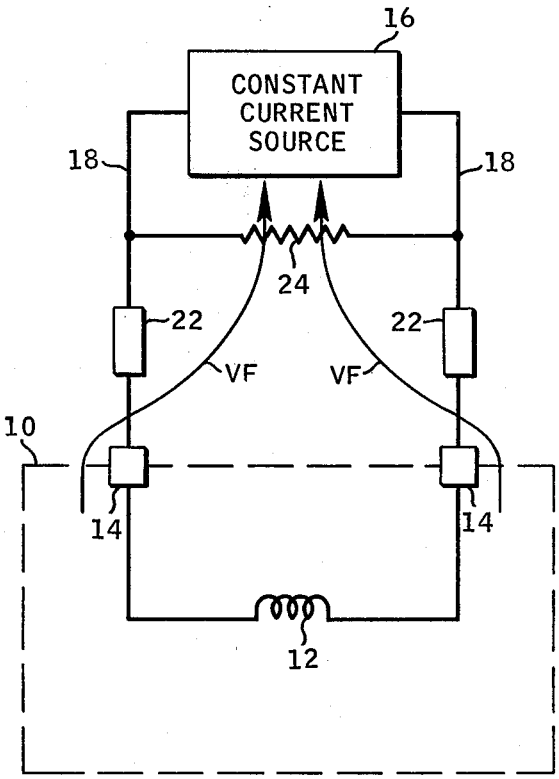
FIG. 4 is a diagrammatic representation of the third embodiment of a superconducting magnet arrangement embodying the novel invention providing a compound compensation using both positive and negative temperature coefficient materials.

In a third embodiment of the invention seen in FIG. 4, the illustrated superconducting magnet arrangement includes both the negative temperature of coefficient materials 22 described in FIG. 2 and the vapor cooled shunt 24 of FIG. 3 in a compound compensating arrangement. In this instance, the vapor flow VF that cools the power leads 14 also contacts and cools the devices 22 and the shunt 24 so as to compensate for variations in power lead resistance and thereby permit the constant current source 16 to maintain a constant level of electrical current through the coil 12.

In the foregoing, it has been demonstrated that the instant invention provides a novel method and structure for compensating for variations in superconducting magnet current flow due to vapor cooled lead resistance changes caused by vapor flow variation.

Many changes may be made in details of the instant invention, in the method and materials of fabrication, in the configuration and assemblage of the constituent elements, without departing from the spirit and scope of the appended claims, which changes are intended to be embraced therewithin.

Having thus described the invention, what is claimed as new and useful and desired to be secured by United States Letters Patent is:

1. In a superconducting magnet arrangement having a sealed cryogenic environment utilizing liquid helium, a superconducting coil immersed in the liquid helium, a constant current power supply exterior of the cryogenic environment and connected to said superconducting coil by electrical leads that penetrate the sealed cryogenic environment and are adapted to be cooled by vapor from the helium that is boiled off the helium due to frictional power losses and flux jump power losses within said superconducting coil, an electrical shunt connected to the superconducting magnet exterior of the cryogenic environment, the improvement comprising:

electrical means coupled to the constant current power supply and to the superconducting coil and arranged to be cooled by the same vapor flow applied to said electrical leads whereby the constant current power supply is permitted to maintain a constant current through the superconducting coil and constant resultant magnetic field as variations in the electrical resistance of said leads occur to vapor boil off of the liquid helium within the sealed cryogenic environment.

2. The arrangement of claim 1 wherein said electrical means comprises negative temperature coefficient resistance means coupled between each electrical lead to the superconducting coil and the constant current power supply and adapted to be cooled by the same vapor from boiled off helium that is applied to said electrical leads.

3. The arrangement of claim 2 wherein said negative coefficient resistance means is connected exteriorly of the cryogenic environment between each electrical lead and a terminal of the constant current power supply.

4. The arrangement of claim 3 wherein each negative temperature coefficient means is cooled by the vapor flow from a single associated vapor cooled electrical lead.

5. The arrangement of claim 1 wherein said electrical means comprises said electrical shunt adapted to be exposed to and cooled by the same vapor flow from the boiled off helium of the cryogenic environment that cools the electrical leads that connect the constant current power supply to the superconducting coil.

6. The arrangement of claim 5 wherein said electrical shunt comprises a positive temperature coefficient material.

7. The arrangement of claim 6 wherein said electrical shunt is exposed to and cooled by the vapor flow from both electrical leads.

8. The arrangement of claim 1 wherein said electrical means comprises a negative temperature coefficient resistance means connected in series with the constant current power supply and the superconducting coil and both the negative temperature coefficient means and the electrical shunt are arranged to be exposed to and cooled by the same vapor flow that cools the electrical leads connecting the constant current power supply to the superconducting coil.

9. The arrangement of claim 8 wherein a negative temperature coefficient resistance means is connected between each vapor cooled electrical lead and the constant current power supply.

10. The arrangement of claim 9 wherein each negative temperature coefficient resistance means is adapted to be exposed to and cooled by the vapor flow from a single electrical lead and the shunt connected in parallel to the superconducting coil is arranged to be exposed to and cooled by the vapor flow from both electrical leads.

11. A method of compensating for variation in electrical resistance of power leads of a superconducting magnet arrangement caused by vapor flow variation in the helium boil off, to which the leads are exposed, of a cryogenic environment, which, if uncorrected permit a shunt connected across the power leads and a superconducting coil of said arrangement to mask from a constant current source the change in current flow through the leads and through said superconducting coil, comprising:

compensating for said vapor flow variations by exposing said vapor flow to resistance means which changes in resistance in proportion to the change in resistance of said power leads and permits the constant current source to maintain a constant level of current through the superconducting coil.

12. The method of claim 11, wherein the resistance means changes resistance in inverse proportion to the change in resistance of the power leads.

13. The method of claim 11, wherein the resistance means changes resistance in direct proportion to the change in resistance of the power leads.

* * * * *